US010941508B2

(12) United States Patent
Kuramashi et al.

(10) Patent No.: US 10,941,508 B2
(45) Date of Patent: Mar. 9, 2021

(54) SEWING MACHINE

(71) Applicant: JUKI CORPORATION, Tokyo (JP)

(72) Inventors: Daishi Kuramashi, Tama (JP); Naofumi Fukuba, Tama (JP)

(73) Assignee: JUKI CORPORATION, Tokyo (JP)

( * ) Notice: Subject to any disclaimer, the term of this patent is extended or adjusted under 35 U.S.C. 154(b) by 440 days.

(21) Appl. No.: 15/724,346

(22) Filed: Oct. 4, 2017

(65) Prior Publication Data

US 2018/0094371 A1 Apr. 5, 2018

(30) Foreign Application Priority Data

Oct. 5, 2016 (JP) ..... JP2016-196847

(51) Int. Cl.
*D05B 27/00* (2006.01)
*D05B 27/06* (2006.01)
(Continued)

(52) U.S. Cl.
CPC ..... *D05B 27/00* (2013.01); *D05B 27/06* (2013.01); *D05B 27/08* (2013.01); *D05B 29/06* (2013.01)

(58) Field of Classification Search
CPC ..... D05B 29/06; D05B 29/12; D05B 27/08; D05B 27/16
(Continued)

(56) References Cited

U.S. PATENT DOCUMENTS 2,282,042 A * 5/1942 Enos ..... D05B 35/02 112/141
2,652,016 A * 9/1953 Enos ..... D05B 27/04 112/235
(Continued)

FOREIGN PATENT DOCUMENTS

CN A-104727027 6/2015
CN U-2046-62016 9/2015
(Continued)

OTHER PUBLICATIONS

JP Office Action dated Sep. 1, 2020 from corresponding Japanese patent application No. 2016-196847 (with attached English-language translation).
(Continued)

*Primary Examiner* — Nathan E Durham
(74) *Attorney, Agent, or Firm* — Faegre Drinker Biddle & Reath LLP

(57) ABSTRACT

A sewing machine includes a feed mechanism which feeds a workpiece by a feed dog partially protruding out upward from an upper surface of a throat plate and moving along a predetermined feeding direction; a presser foot which presses the workpiece on the upper surface of the throat plate from above; a feed guide which has an abutting surface along the feeding direction and guides feeding of the workpiece; and a control device. The feed mechanism includes a lateral feed mechanism which adds a moving component in a direction along the upper surface of the throat plate and orthogonal to the predetermined feeding direction, to the feed dog. The control device controls the feed mechanism to feed the workpiece by adding a moving component to a side of the abutting surface of the feed guide by the lateral feed mechanism, in addition to the feeding along the regulated feeding direction.

2 Claims, 6 Drawing Sheets

(51) Int. Cl.
*D05B 27/08* (2006.01)
*D05B 29/06* (2006.01)

(58) Field of Classification Search
USPC ..... 112/324
See application file for complete search history.

(56) References Cited

U.S. PATENT DOCUMENTS

| | | | | | |
|---|---|---|---|---|---|
| 2,672,833 | A * | 3/1954 | Ritter | D05B 35/10 | 112/151 |
| 3,795,209 | A | 3/1974 | Smith | | |
| 4,473,019 | A | 9/1984 | Hanyu et al. | | |
| 4,958,580 | A * | 9/1990 | Asaba | D05B 27/02 | 112/314 |
| 4,967,674 | A * | 11/1990 | Rohr | D05B 27/02 | 112/153 |
| 5,050,514 | A | 9/1991 | Niederkorn | | |
| 5,054,407 | A | 10/1991 | Rowley | | |
| 7,721,664 | B2 * | 5/2010 | Woolley | D05B 27/00 | 112/314 |
| 2012/0079974 | A1 * | 4/2012 | Tseng | D05B 27/02 | 112/324 |
| 2015/0167217 | A1 | 6/2015 | Yokoyama et al. | | |
| 2017/0321361 | A1 * | 11/2017 | Capt | D05B 27/02 | |

FOREIGN PATENT DOCUMENTS

| | | |
|---|---|---|
| CN | A-105401345 | 3/2016 |
| CN | U-205077236 | 3/2016 |
| JP | U-S58-061173 | 4/1983 |
| JP | A-S62-201182 | 9/1987 |
| JP | H06-270 A | 1/1994 |

OTHER PUBLICATIONS

CN Office Action dated Sep. 11, 2020 in Chinese Application No. 201710930688.7 (with attached English-language translation).
TW Office Action dated Sep. 23, 2020 from corresponding Taiwanese patent application No. 106134349 (with attached English-language translation).

* cited by examiner

SEWING MACHINE

CROSS-REFERENCE TO RELATED APPLICATION

The present application claims the benefit of priority of Japanese Patent Applications No. 2016-196847, filed on Oct. 5, 2016, the disclosure of which is incorporated herein by reference.

TECHNICAL FIELD

The invention relates to a sewing machine which performs feeding along a side edge portion of a workpiece.

BACKGROUND ART

Since sewing by a sewing machine is generally performed while determining a feeding direction by manually pressing a workpiece fed by a feed dog, it is difficult to stably perform the sewing while maintaining a constant distance along a side edge portion of the workpiece.

Therefore, the sewing machine of the related art is equipped with a feed guide which allows the side edge portion of the workpiece to abut against a presser foot that presses the workpiece from above, and when performing the sewing, by feeding the workpiece along the feed guide, it is possible to stably perform the sewing while maintaining a constant distance along the side edge portion of the workpiece (for example, refer to JP-A-H6-270).

However, in the sewing machine of the related art, it is necessary to feed the workpiece while manually pressing the workpiece to maintain a state where the side edge portion of the workpiece abuts against the side wall of the feed guide, and thus, it is difficult to sufficiently stably perform the sewing.

In addition, there is also a problem that the burden on an operator increases.

SUMMARY OF THE INVENTION

An object of the invention is to stably perform sewing while maintaining a constant distance along a side edge portion of a workpiece, and the invention is characterized as the following (1) to (5) below.

(1) A sewing machine including:

a feed mechanism which feeds a workpiece by a feed dog partially protruding out upward from an upper surface of a throat plate and moving along a predetermined feeding direction;

a presser foot which presses the workpiece on the upper surface of the throat plate from above;

a feed guide which has an abutting surface along the feeding direction and guides feeding of the workpiece; and a control device, wherein the feed mechanism includes a lateral feed mechanism which adds a moving component in a direction along the upper surface of the throat plate and orthogonal to the predetermined feeding direction, to the feed dog, and wherein the control device controls the feed mechanism to feed the workpiece by adding a moving component to a side of the abutting surface of the feed guide by the lateral feed mechanism, in addition to the feeding along the regulated feeding direction.

(2) The sewing machine according to (1), wherein the feed guide is provided in the presser foot.

(3) The sewing machine according to (1) or (2), wherein the feed guide is provided to be oscillatable in an upward-and-downward direction with respect to the presser foot in a state of being pressed downward by an elastic body.

(4) The sewing machine according to (2) or (3), wherein the presser foot is attachable to and detachable from a presser bar which supports the presser foot, and the presser foot which is provided with the feed guide is exchangeable with another presser foot which is not provided with the feed guide.

(5) The sewing machine according to (4), wherein the control device controls the feed mechanism to feed the workpiece by adding the moving component to the side of the abutting surface of the feed guide by the lateral feed mechanism in a case where the presser foot provided with the feed guide is mounted on the presser bar.

In the invention, since transport is performed while the side edge portion of the workpiece is pressed to the abutting portion of the feed guide, the operator can perform the sewing with respect to the workpiece while maintaining the constant distance from the side edge portion thereof without consciously pressing it to the feed guide, and thus, it is possible to stably perform the sewing along an edge portion of the workpiece. In addition, in this manner, it is possible to reduce the burden on the operator for stably performing the sewing.

DETAILED DESCRIPTION

Overall Configuration of Sewing Machine

Figure 1:
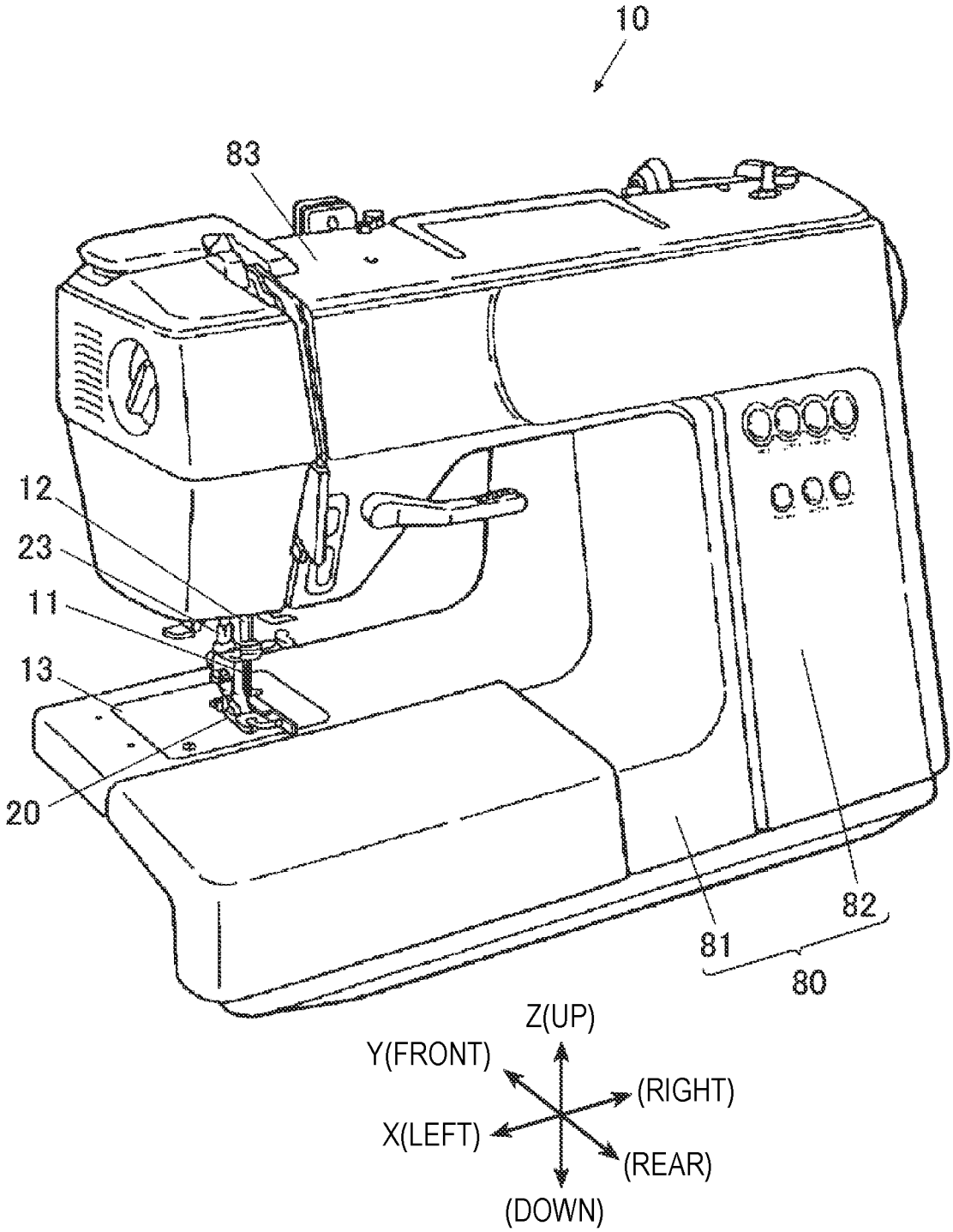
FIG. 1 is a perspective view of a sewing machine according to an embodiment of the invention.

Hereinafter, a sewing machine 10 according to an embodiment of the invention will be described in detail with reference to the drawings. FIG. 1 is a perspective view of the sewing machine 10. In the sewing machine 10, in a state of being loaded on a horizontal surface, an upper surface of a throat plate 13 thereof becomes horizontal, and cloth which is a workpiece is fed along the upper surface of the throat plate 13. In addition, in the following description, a direction which is parallel to the upper surface of the throat plate 13 and in which the workpiece is fed is set to be a Y-axis direction, a direction which is parallel to the upper surface of the throat plate 13 and is orthogonal to the Y-axis direction is set to be an X-axis direction, and a direction which is perpendicular to the throat plate 13 is set to be a Z-axis direction. In addition, as illustrated in FIG. 1, one side in the X-axis direction is defined as a leftward direction, the other side in the X-axis direction is defined as a rightward direction, one side in the Y-axis direction is defined as a forward direction, the other side in the Y-axis direction is defined as a rearward direction, one side in the Z-axis direction is defined as an upward direction, and the other side in the Z-axis direction is defined as a downward direction.

The sewing machine 10 includes a needle vertical movement mechanism which vertically moves a needle bar 12 including a sewing needle 11; a feed mechanism 30 which feeds the workpiece on the throat plate 13 at a constant pitch in synchronization with the vertical movement of the needle bar 12; a shuttle mechanism which entwines a bobbin thread by catching a needle thread from the sewing needle 11; a thread take-up lever mechanism which pulls up the needle thread that performs the vertical movement in synchronization with the needle bar; a presser foot 20 which presses cloth loaded on the throat plate 13 from above; a frame 80; a control device 90 which performs operation control of each portion, and the like.

In addition, since the needle vertical movement mechanism, the shuttle mechanism, and the thread take-up lever mechanism have the same known structure, specific description thereof will be omitted here.

In addition, the needle vertical movement mechanism of the sewing machine 10 supports the needle bar 12 to be oscillatable such that the sewing needle 11 reciprocates along the X-axis direction, arbitrarily performs needle oscillation in the X-axis direction by allowing the needle bar 12 to oscillate by a needle oscillation motor 16 (refer to FIG. 4), and can form an arbitrary sewing pattern by combining a feed operation in a normal direction and a feed operation in a reverse direction along the Y-axis direction of the cloth with each other.

Frame

The frame 80 includes a bed portion 81 which extends along the X-axis direction; an upright drum portion 82 which stands from a right end portion of the bed portion 81; and an arm portion 83 which extends leftward from an upper end portion of the upright drum portion 82.

Feed Mechanism: Overall Configuration

Figure 2:
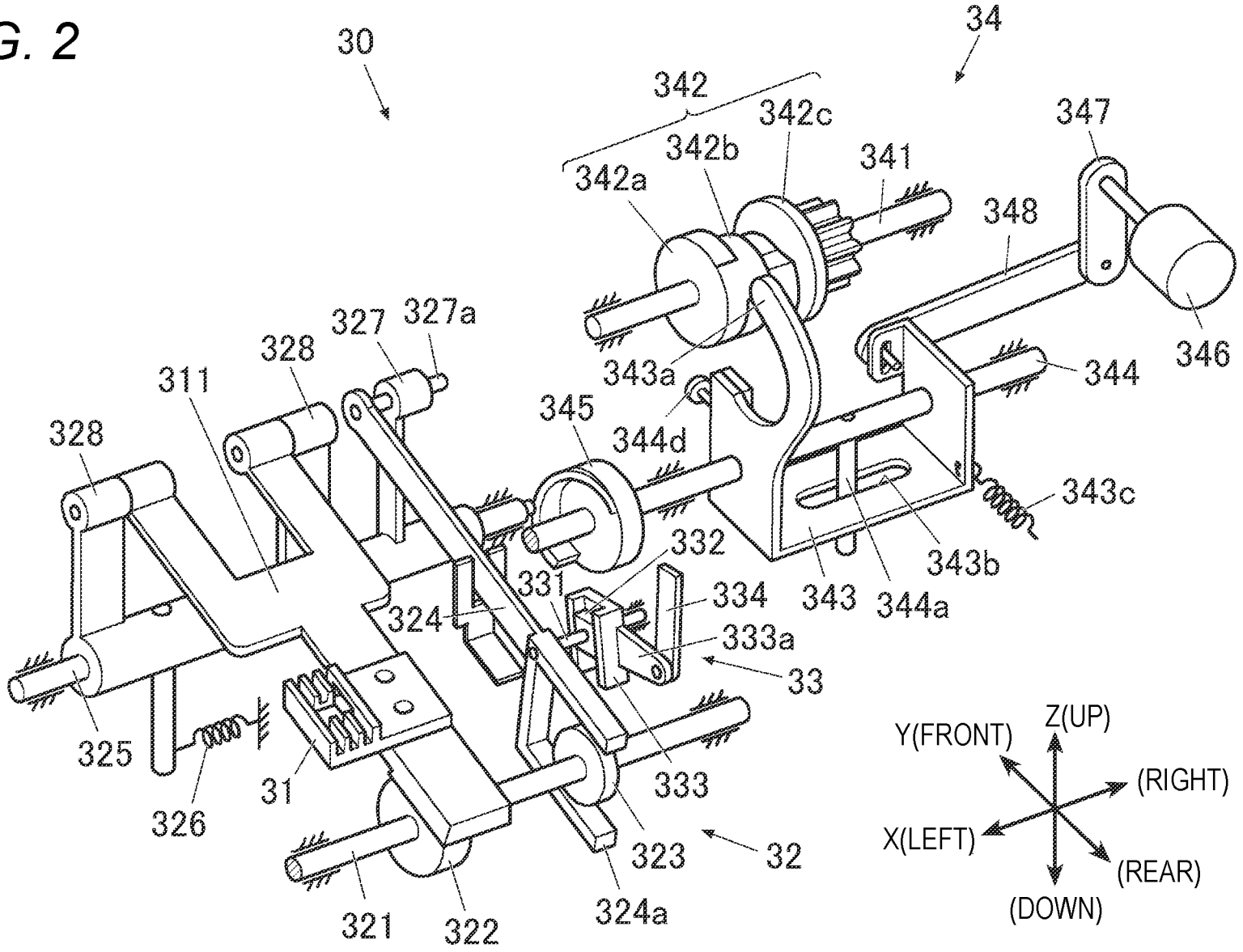
FIG. 2 is a perspective view illustrating a configuration of a feed mechanism.

FIG. 2 is a perspective view illustrating the overall configuration of the feed mechanism 30.

The feed mechanism 30 of the sewing machine 10 is accommodated in the bed portion 81 in the frame 80.

In addition, the feed mechanism 30 includes a feed dog 31 which partially protrudes out upward from an opening portion of the throat plate 13; a forward-and-rearward feed mechanism 32 which allows the feed dog 31 to reciprocate forward and rearward along the Y-axis direction; a feed adjustment mechanism 33 which adjusts forward and rearward feed pitches of the feed dog 31; and a lateral feed mechanism 34 which allows the feed dog 31 to reciprocate leftward and rightward along the X-axis direction.

Feed Mechanism: Feed Dog

In the feed dog 31, a plurality of saw-toothed teeth are formed to be aligned in the Y-axis direction in an upper portion thereof, and the opening portion in which a stitch point is performed is formed at the center thereof.

The feed dog 31 is equipped to be fixed to the center of a plate-like feed dog bracket 311 which is long in the Y-axis direction. In the feed dog bracket 311, a reciprocating operation along the forward-and-rearward direction is input from a front end portion thereof, and a reciprocating operation along the upward-and-downward direction is input from a rear end portion thereof, by the forward-and-rearward feed mechanism 32.

Both of the reciprocating operation along the forward-and-rearward direction and the reciprocating operation along the upward-and-downward direction which are input into the feed dog bracket 311 have the same cycle as that of the vertical movement of the needle bar 12, a phase of the reciprocating operation along the forward-and-rearward direction is appropriately adjusted with respect to a phase of the reciprocating operation along the upward-and-downward direction, and an elliptical movement in which the reciprocating operation along the forward-and-rearward direction and the reciprocating operation along the upward-and-downward direction are combined with each other is given to the feed dog 31 positioned at the center of the feed dog bracket 311. For example, the feed adjustment mechanism 33 adjusts the phase so as to move it forward when the feed dog 31 passes through the upper portion in the track of the elliptical movement, thereby feeding the cloth forward. On the contrary, the feed adjustment mechanism 33 adjusts the phase so as to move it rearward when the feed dog 31 passes through the upper portion in the track of the elliptical movement, thereby feeding the cloth rearward.

Feed Mechanism: Forward-and-Rearward Feed Mechanism

The forward-and-rearward feed mechanism 32 includes: a vertical feed shaft 321 to which all rotations are transmitted during the same cycle from an upper shaft which gives the vertical movement to the needle bar 12; an upward-and-downward feed cam 322 and a forward-and-rearward feed cam 323 which are equipped to be fixed to the vertical feed shaft 321; a forward-and-rearward feed rod 324 to which the reciprocating operation is given from the forward-and-rearward feed cam 323; and a transmission shaft 325 to which a reciprocating rotation operation is input from the forward-and-rearward feed rod 324.

The vertical feed shaft 321 extends along the X-axis direction, and is supported to be rotatable by the bed portion 81.

The upward-and-downward feed cam 322 is an eccentric cam, an outer circumference thereof abuts against a bottom surface of the rear end portion of the feed dog bracket 311, and the upward-and-downward feed cam 322 gives the reciprocating operation along the upward-and-downward direction to the feed dog bracket 311.

In addition, the rear end portion of the feed dog bracket 311 is pressed downward by a spring which is not illustrated such that a state of always abutting against the outer circumference of the upward-and-downward feed cam 322 is maintained.

The forward-and-rearward feed cam 323 is an eccentric cam, an outer circumference thereof abuts against a frame-like portion 324*a* formed in the rear end portion of the forward-and-rearward feed rod 324, and the forward-and-rearward feed cam 323 gives the reciprocating operation along the upward-and-downward direction to the frame-like portion 324*a*.

The frame-like portion 324*a* of the forward-and-rearward feed rod 324 is formed in a U shape that is open rearward. In addition, on an inner side of the frame-like portion 324*a*, the forward-and-rearward feed cam 323 is disposed, and an upper portion and a lower portion the forward-and-rearward feed cam 323 abut against the inner side of the frame-like portion 324*a*, respectively.

The forward-and-rearward feed rod 324 extends along the Y-axis direction, and the reciprocating operation along the upward-and-downward direction is input from the forward-and-rearward feed cam 323 into the rear end portion of the forward-and-rearward feed rod 324.

In addition, a coupling shaft 331 which is along the X-axis direction and is a part of the feed adjustment mechanism 33 is coupled to the forward-and-rearward feed rod 324 to be rotatable in the vicinity of the frame-like portion 324*a*, and the feed adjustment mechanism 33 which will be described later regulates the moving direction at the coupling position with the coupling shaft 331 to perform the reciprocating movement in an inclined forward and rearward direction with respect to the upward-and-downward direction.

Accordingly, the front end portion of the forward-and-rearward feed rod 324 can perform the reciprocating movement in the forward-and-rearward direction.

The transmission shaft 325 extends along the X-axis direction, and is supported to be rotatable by the bed portion 81 and to be slidable along the X-axis direction.

In addition, the reciprocating operation along the X-axis direction is input to the transmission shaft 325 by the lateral feed mechanism 34 from the right end portion thereof. Therefore, in order to maintain a state of abutting against the lateral feed mechanism 34, the transmission shaft 325 is pressurized in the rightward direction by a spring 326.

Furthermore, in the vicinity of the right end portion of the transmission shaft 325, an input arm 327 which extends toward the outer side (upward) in a radial direction around the transmission shaft 325 is equipped to be fixed.

An extending end portion of the input arm 327 is coupled to the front end portion of the forward-and-rearward feed rod 324 in a state of being rotatable around the X axis by a pin 327*a* along the X-axis direction.

Therefore, the reciprocating operation along the forward-and-rearward direction is input from the forward-and-rearward feed rod 324 to the rotation end portion of the input arm 327, and it is possible to transmit the reciprocating rotation operation to the transmission shaft 325.

In addition, by the lateral feed mechanism 34, the feed dog 31, the feed dog bracket 311, the transmission shaft 325, the input arm 327, and an output arm 328 which will be described later perform the reciprocating operation in the leftward-and-rightward direction (X-axis direction), but the input arm 327 is coupled to the forward-and-rearward feed rod 324 via the pin 327*a* which is long in the X-axis direction, and thus, as the pin 327*a* slides during the reciprocating operation in the leftward-and-rightward direction, it is possible to maintain the state of being coupled to each other.

In addition, in the vicinity of a left end portion of the transmission shaft 325, one pair of output arms 328 which extend toward the outer side (upward) in the radial direction around the transmission shaft 325 are equipped to be fixed.

The rotation end portion of the output arms 328 is coupled to the front end portion of the feed dog bracket 311 to be rotatable around the X axis, each of the output arms 328 performs the reciprocating operation in the forward-and-rearward direction integrated with the input arm 327, and transmits the reciprocating operation in the forward-and-rearward direction to the feed dog bracket 311.

Feed Mechanism: Feed Adjustment Mechanism

The feed adjustment mechanism 33 includes the coupling shaft 331 which is coupled to the forward-and-rearward feed rod 324; an angular segment 332 which is coupled to the coupling shaft 331; a guide 333 which supports the angular segment 332 to be slidable along a straight line groove; and a feed adjust motor 335 (refer to FIG. 4) which changes and adjusts the orientation of the straight line groove of the guide 333 via a link member 334 coupled to an arm portion 333*a* that extends from the guide 333.

The guide 333 can change and adjust the reciprocating operation direction in the vicinity of the rear end portion of the above-described forward-and-rearward feed rod 324 via the angular segment 332 and the coupling shaft 331 with the straight line groove.

For example, in a state where the straight line groove of the guide 333 is oriented in the upward-and-downward direction (Z-axis direction), the rear end portion of the forward-and-rearward feed rod 324 oscillates only in the upward-and-downward direction around the pin 327*a*, the reciprocating operation component in the forward-and-rearward direction is not generated, and thus, a state where the reciprocating operation in the forward-and-rearward direction is not transmitted, that is, a state where the feed pitch is 0, is achieved in the feed dog bracket 311 and the feed dog 31.

In addition, when the straight line groove of the guide 333 is inclined to the front side (a direction of advancing as going upward) with respect to the upward-and-downward direction, the rear end portion of the forward-and-rearward feed rod 324 performs the reciprocating operation along the forward-obliquely upward direction, and the reciprocating operation forward and rearward in a normal feeding direction is transmitted, for example, to the feed dog bracket 311 and the feed dog 31. In addition, a stroke of the reciprocating operation in the forward-and-rearward direction increases as the inclination to the front side of the straight line groove of the guide 333 increases, and it is possible to increase the feed pitch in the normal direction.

In addition, when the straight line groove of the guide 333 is inclined to the rear side (a direction of retreating as going upward) with respect to the upward-and-downward direction, the rear end portion of the forward-and-rearward feed rod 324 performs the reciprocating operation in the rearward-obliquely upward direction, and the reciprocating operation forward and rearward in the reverse feeding direction is transmitted, for example, to the feed dog bracket 311 and the feed dog 31. In addition, a stroke of the reciprocating operation in the forward-and-rearward direction increases as the inclination to the rear side of the straight line groove of the guide 333 increases, and it is possible to increase the feed pitch in the reverse direction.

Feed Mechanism: Lateral Feed Mechanism

The lateral feed mechanism 34 includes a lateral feed shaft 341 to which all the rotations are transmitted during the same cycle from the upper shaft which gives the vertical movement to the needle bar 12; a lateral feed cam 342 which is equipped to be fixed to the lateral feed shaft 341 and in which three cams 342*a* to 342*c* are integrated with each other; a contactor 343 which includes an abutting arm 343*a* which selectively abuts against the three cams 342*a* to 342*c*; a contactor shaft 344 which supports the contactor 343 to be rotatable; an end surface cam 345 which is equipped to be fixed to one end portion of the contactor shaft 344; a lateral feed motor 346 which gives a switching operation of the cams 342*a* to 342*c* against which the abutting arm 343*a* of the contactor 343 abuts; and two link members 347 and 348 which transmit the switching operation of the contactor 343 by torque of the lateral feed motor 346.

The lateral feed shaft 341 extends along the X-axis direction, and is supported to be rotatable by the bed portion 81.

The lateral feed cam 342 is an outer circumferential cam in which the leftward feed cam 342*a* which feeds the feed dog 31 leftward, the neutral cam 342*b* which does not generate movement in the leftward-and-rightward direction, and the rightward feed cam 342*c* which feeds the feed dog 31 rightward are integrated in a state of being aligned along the X-axis direction. In addition, by the movement along the X-axis direction of the contactor 343, the tip end portion of the abutting arm 343*a* selectively abuts against the outer circumference of each of the cams 342*a* to 342*c*, and a leftward feeding state, a rightward feeding state, and a state of feeding neither leftward nor rightward, can be switched with respect to the feed dog 31.

The contactor shaft 344 extends along the X-axis direction, and is supported to be rotatable by the bed portion 81.

The end surface cam 345 is equipped to be fixed to the left end portion of the contactor shaft 344, and the left end surface that serves as the cam is disposed to abut against the right end portion of the above-described transmission shaft 325. As the end surface cam 345 rotates together with the contactor shaft 344, the left end surface that serves as the cam has a shape of which displacement in the X-axis direction changes, and a shape by which the feed dog bracket 311 and the feed dog 31 can move rightward through the forward rotation and the feed dog bracket 311 and the feed dog 31 can move leftward through the rearward rotation.

In addition, in a case where the abutting arm 343*a* is at a position that opposes the neutral cam 342*b*, the end surface cam 345 maintains the state where the right end portion of the transmission shaft 325 abuts against the neutral position that regards the feed dog 31 as a reference position.

In addition, in a case where the abutting arm 343*a* is at a position that opposes the above-described leftward feed cam 342*a*, the abutting arm 343*a* oscillates around the contactor shaft 344 along the end surface of the leftward feed cam 342*a*, and thus, the contactor shaft 344 also oscillates via an interlocking pin 344*a*, and accordingly, the end surface cam 345 repeatedly performs an operation for returning to the neutral position by performing the rearward rotation, and further, the forward rotation from the neutral position.

In addition, in a case where the abutting arm 343*a* is at a position that opposes the above-described rightward feed cam 342*c*, the abutting arm 343*a* oscillates around the contactor shaft 344 along the end surface of the rightward feed cam 342*c*, and thus, the contactor shaft 344 also oscillates via an interlocking pin 344*a*, and accordingly, the end surface cam 345 repeatedly performs an operation for returning to the neutral position by performing the forward rotation, and further, the rearward rotation from the neutral position.

The contactor 343 is a U-shaped frame body configured of one pair of opposing wall surfaces along a Y-Z plane and a coupling wall surface which couples the opposing wall surfaces to each other, and the contactor shaft 344 is inserted into a through hole formed at the center of the one pair of opposing wall surfaces. In addition, a long hole 343*b* along the X-axis direction is formed on the coupling wall surface, and the interlocking pin 344*a* which extends in the radial direction from the contactor shaft 344 is inserted thereinto.

The contactor 343 rotates together with the contactor shaft 344 by the interlocking pin 344*a*, and without being bound by the interlocking pin 344*a* due to the long hole 343*b*, the contactor 343 can move in the X-axis direction with respect to the contactor shaft 344.

In addition, in the contactor 343, a spring 343*c* which gives the rotation in the direction in which the tip end portion of the abutting arm 343*a* abuts against the outer circumference of each of the cams 342*a* to 342*c* of the lateral feed cam 342 is coupled to one of opposing wall surfaces, and on the other opposing wall surface, a stopper 344*d* which regulates excessive rotation of the tip end portion of the abutting arm 343*a* is also provided. The stopper 344*d* can adjust a regulation position by a screw structure.

In the lateral feed motor 346, the output shaft thereof is oriented in the Y-axis direction, and the upper end portion of the link member 347 along the Z-axis direction is equipped to be fixed to the output shaft. By the lateral feed motor 346, the lower end portion of the link member 347 oscillates in the leftward-and-rightward direction, and the link member 348 transmits the operation in the leftward-and-rightward direction to the contactor 343.

By the above-described feed mechanism 30, the feed dog 31 can perform the forward feed operation of the workpiece along the Y-axis direction, the reverse feed operation, and the adjustment of the feed pitches of both of the operations.

In addition, the cam shape of the leftward feed cam 342*a* and the rightward feed cam 342*c* of the lateral feed cam 342 is set such that the leftward-and-rightward feed operation is generated in synchronization with the forward-and-rearward feed operation by the forward-and-rearward feed mechanism 32.

Presser Foot

Figure 3:
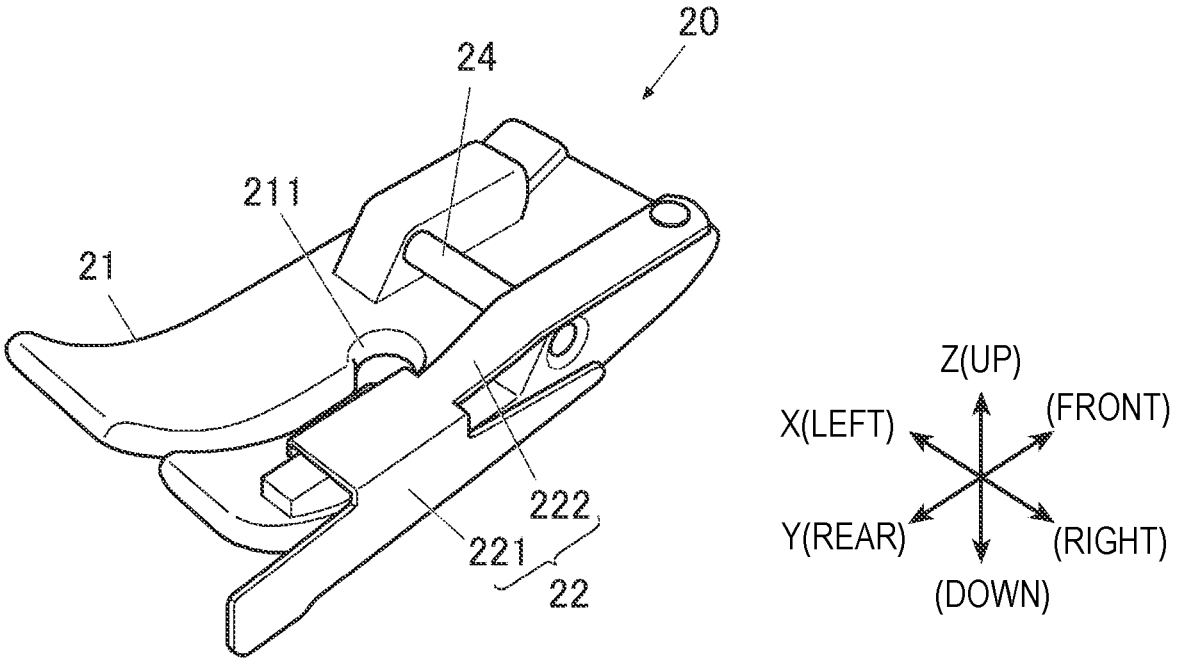
FIG. 3 is a perspective view of a presser foot.

FIG. 3 is a perspective view of the presser foot 20.

As illustrated in FIG. 3, the presser foot 20 includes a substantially rectangular presser plate 21 when viewed in a plan view; and a feed guide 22 which has an abutting surface along the forward-and-rearward feeding direction of cloth C.

The presser foot 20 is attachable to and detachable from the lower end portion of a presser bar 23 which can perform the vertical movement in the vicinity of the left end portion of the arm portion 83 and is pressed downward by a spring which is not illustrated.

The presser plate 21 has a shape of which the rear end portion is curved upward so that the cloth C is guided below the presser plate 21.

In addition, an insertion hole 211 into which the sewing needle 11 can be loosely inserted is formed in the center portion of the presser plate 21, and a slit is formed from the rear end portion of the presser plate 21 to the insertion hole 211.

Furthermore, in front of the insertion hole 211 of the presser plate 21, an attaching and detaching structure by which the presser plate is attachable to and detachable from the lower end portion of the presser bar 23 is formed. The attaching and detaching structure is configured of a coupling pin 24 provided along the X-axis direction. In other words, in the lower end portion of the presser bar 23, a latch structure including a claw that elastically nips the coupling pin 24 is provided, and the claw of the latch structure includes an operation portion that releases the holding state from the outside.

Therefore, the presser plate 21 can be mounted on the presser bar 23 by pressing the coupling pin 24 to be nipped by the claw of the latch structure of the lower end portion of the presser bar 23, and can be separated from the presser bar 23 by performing the releasing operation of the holding state of the claw with respect to the operation portion of the latch structure.

The feed guide 22 is formed of an abutting portion 221 including a guide surface along an X-Z plane, and a support portion 222 which elastically supports the abutting portion 221, and the abutting portion 221 and the support portion 222 are formed by folding one elastic metal sheet at a right angle.

The support portion 222 has a shape of a flat plate along the X-Y plane, is an elongated plate spring which is long in the Y-axis direction, and the front end portion thereof is fixed to the upper surface of the front end of an edge portion on the right side of the presser plate 21. In addition, the rear end portion of the support portion 222 is a free end, and the support portion 222 has a structure which is bent in the upward-and-downward direction by the elasticity thereof.

The abutting portion 221 is provided on the right side of the rear end portion of the support portion 222, has a shape of a flat plate along the Y-Z plane, and is an elongated member which is long in the Y-axis direction.

The abutting portion 221 is positioned further on the right side of the edge portion on the right side of the presser plate 21, and is elastically supported by the support portion 222 such that the lower end portion of the abutting portion 221 protrudes further downward than the bottom surface of the presser plate 21.

Therefore, in a case where the presser foot 20 presses the cloth C from above, the abutting portion 221 of the feed guide 22 protrudes further downward than the bottom surface of the presser plate 21 by the thickness of the cloth C, and is placed in a state of abutting against the right edge portion of the cloth C regarding the left plane thereof as the abutting surface.

Accordingly, in a case of feeding the cloth C forward (or rearward), it is possible to guide the right edge portion of the cloth C along the abutting portion 221, and to feed the cloth C straight along the right edge portion.

In addition, by mounting a general presser foot (presser foot configured only of the presser plate 21) which does not include the feed guide 22 on the lower end portion of the presser bar 23, it is also possible to perform general sewing regardless that the presser foot is parallel to the right edge portion of the cloth C.

In other words, the sewing machine 10 can perform sewing by appropriately selecting between the general presser foot and the presser foot 20 illustrated in FIG. 3 and mounting the selected presser foot depending on the sewing.

Control System of Sewing Machine

Figure 4:
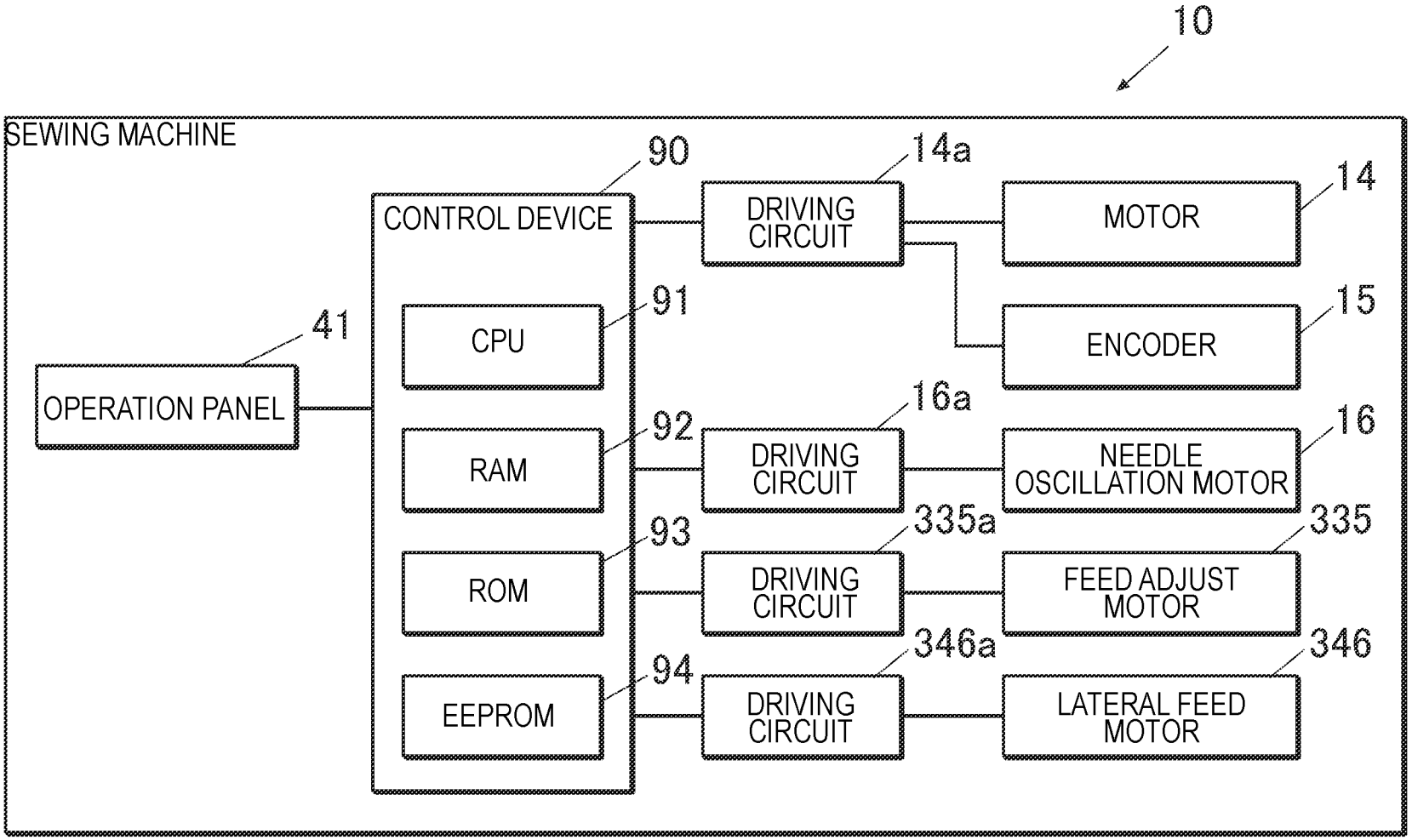
FIG. 4 is a block diagram illustrating a control system of the sewing machine.

FIG. 4 illustrates a control system of the sewing machine 10.

The sewing machine 10 includes the control device 90 which performs operation controls of each of the configurations, and a motor 14 which is a driving source of a sewing operation and an encoder 15 which detects an output shaft angle (upper shaft angle) thereof are connected to the control device 90 via a driving circuit 14*a*.

In addition, the needle oscillation motor 16, and the feed adjust motor 335 and the lateral feed motor 346 of the feed mechanism 30, are connected to the control device 90 via driving circuits 16*a*, 335*a*, and 346*a*.

In addition, an operation panel 41 which functions as operating means by which an operator of the sewing machine performs the setting, the operation input or the like with respect to the sewing machine, is connected to the control device 90 via an interface which is not illustrated.

For example, the setting value of the stitching pitch of the sewing machine, the type of the presser foot which is currently mounted on the presser bar 23, or the like is input from the operation panel 41.

The control device 90 mainly includes a CPU 91 which performs control of the motor 14; a RAM 92 which is a work area of the CPU 91; a ROM 93 in which a program processed by the CPU 91 is stored; and an EEPROM 94 that functions as a storage portion in which data used in arithmetic processing is stored and which is configured to be capable of rewriting the data.

Sewing Operation

The characteristic sewing operation of the sewing machine 10 which is executed by the control device 90 will be described based on an operation description view of FIG. 5 and a flowchart of FIG. 6.

In addition, as described above, the sewing machine 10 can also perform the sewing of an arbitrary sewing pattern by combining the needle oscillation along the X-axis direction and the normal and reverse feed operations along the Y-axis direction, but here, not the pattern sewing, but a sewing operation in which a seam is formed along a certain direction without performing the needle oscillation, is described as an example.

When receiving a sewing start command, the CPU 91 of the control device 90 determines whether the presser foot which is currently mounted on the presser bar 23 is the presser foot 20 having the feed guide or the general presser foot which does not have the feed guide, by reading the setting data (step S1).

In addition, in a case where the current presser foot is the presser foot 20 having the feed guide (step S1: YES), the lateral feed motor 346 is controlled, and the contactor 343 is moved to the position at which the abutting arm 343*a* abuts against the outer circumference of the rightward feed cam 342*c* (step S3).

In addition, in a case where the current presser foot is the general presser foot (step S1: NO), the lateral feed motor 346 is controlled, and the contactor 343 is moved to the position at which the abutting arm 343*a* abuts against the outer circumference of the neutral cam 342*b* (step S5).

Next, the CPU 91 of the control device 90 reads the value of the set stitching pitch from the setting data (step S7).

In addition, the feed adjust motor 335 is controlled, and the guide 333 of the feed adjustment mechanism 33 is inclined to achieve an inclination angle which corresponds to the set stitching pitch (step S9).

Then, the driving of the motor 14 is started (step S11).

In a case of executing the sewing by the presser foot 20 having the feed guide, the sewing is performed in a state where the abutting arm 343*a* abuts against the outer circumference of the rightward feed cam 342*c*, and thus, the end surface cam 345 abuts against the transmission shaft 325, and moves the feed dog 31 in the rightward direction at the same cycle as that of the vertical movement of the needle bar 12.

Figure 5:
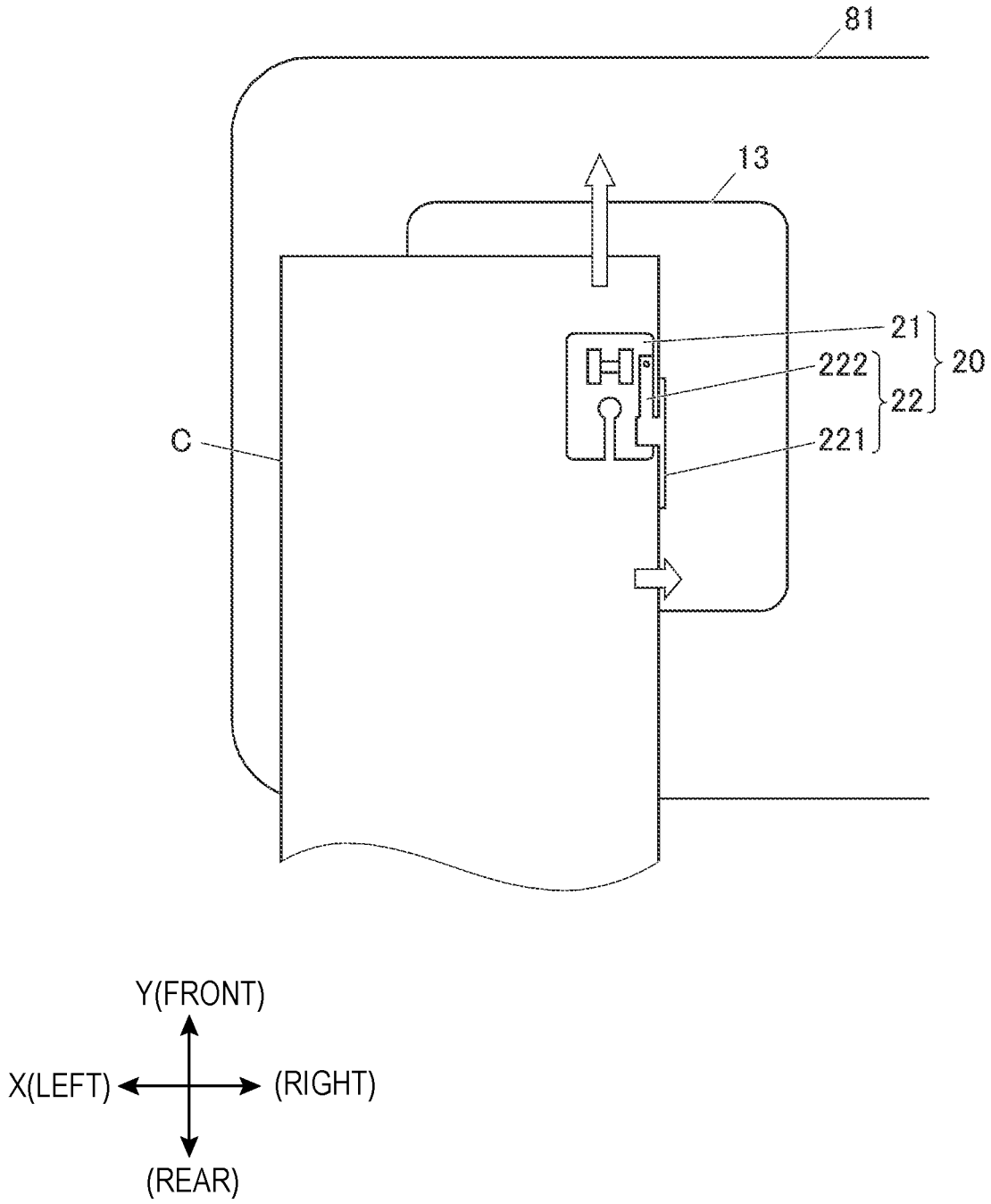
FIG. 5 is a plan view of the periphery of a throat plate illustrating an operation of sewing.
Figure 6:
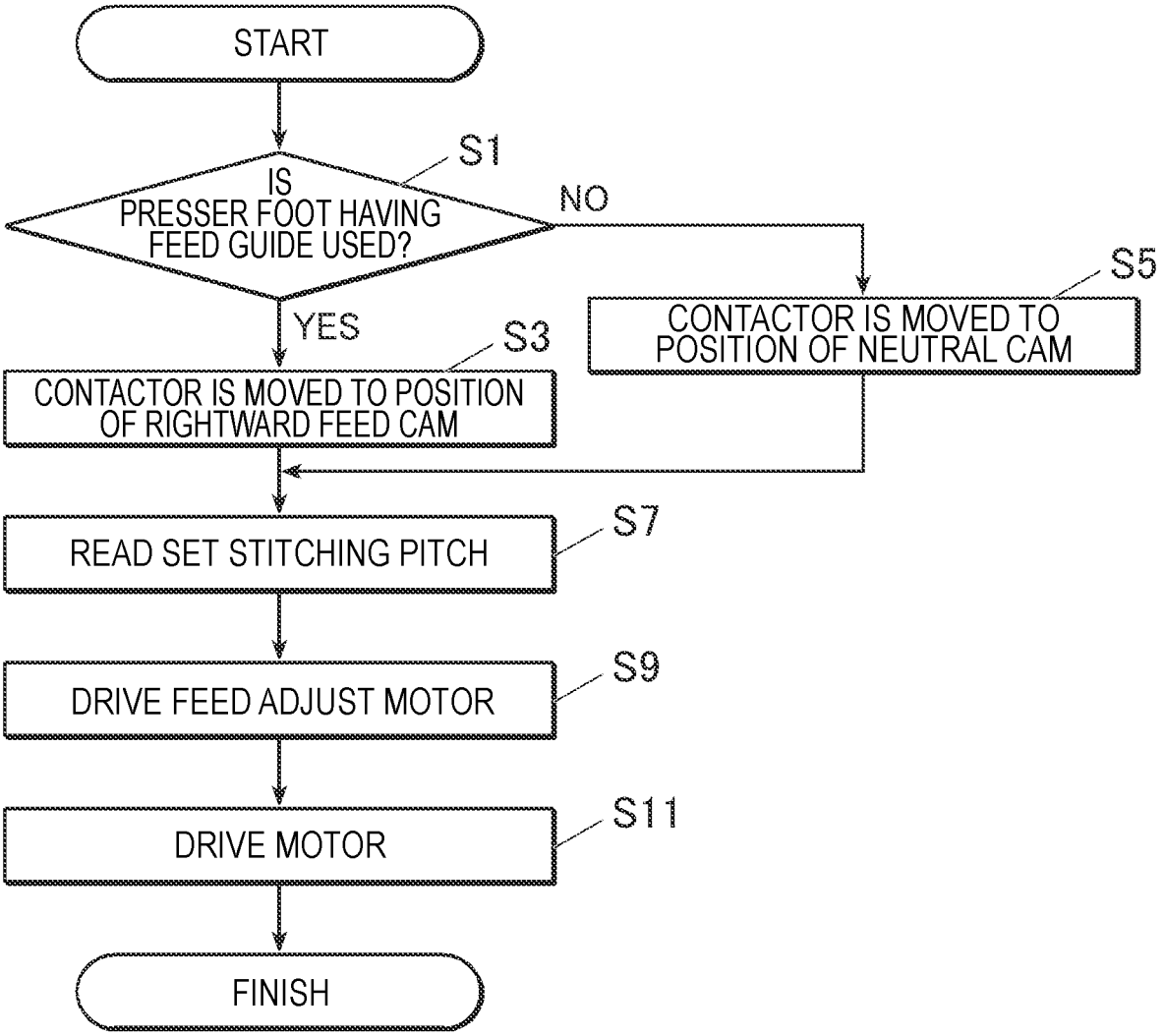
FIG. 6 is a flowchart of sewing control.

Accordingly, as illustrated in FIG. 5, during the sewing, the feed dog 31 performs the feeding of the cloth C in both of the advancing direction and the rightward direction.

In addition, since the feed guide 22 is equipped in the presser foot 20, the edge portion on the right side of the cloth C is transported while abutting against the left surface of the abutting portion 221 of the feed guide 22, and being pressed toward the left surface of the abutting portion 221.

Therefore, it is not necessary for the operator to press the cloth C while consciously tightly pressing the cloth C to the feed guide 22, and the operator can perform the sewing while maintaining a constant distance from the edge portion on the right side with respect to the cloth C.

In addition, in a case of executing the sewing by the general presser foot that does not have the feed guide, the sewing is performed in a state where the abutting arm 343*a* abuts against the outer circumference of the neutral cam 342*b*, and thus, the end surface cam 345 holds the transmission shaft 325 at a certain neutral position, and the feed dog 31 does not move in the leftward-and-rightward direction.

Accordingly, during the sewing, the feed dog 31 performs the feeding of the cloth C in the advancing direction.

In addition, when receiving a sewing finish command, the CPU 91 of the control device 90 stops the driving of the motor 14, and finishes the sewing.

TECHNICAL EFFECTS OF EMBODIMENT

As described above, in the sewing machine 10, the feed mechanism 30 includes the lateral feed mechanism 34 which adds the moving component in the direction along the upper surface of the throat plate 13, that is, in the X-axis direction orthogonal to the Y-axis direction which is the predetermined feeding direction, to the feed dog 31, and the control device 90 controls the feed mechanism 30 to feed the cloth C by adding the moving component to the side of the abutting surface of the feed guide 22 by the lateral feed mechanism 34 in addition to the feeding along the Y-axis direction.

Therefore, the transporting is performed while the edge portion on the right side of the cloth C is pressed to the left surface of the abutting portion 221 of the feed guide 22, and it is possible to perform the sewing while maintaining a constant distance from the edge portion on the right side with respect to the cloth C without consciously pressing the cloth C to the feed guide 22 by the operator.

As a result, it is possible to stably perform the sewing along the edge portion of the cloth C. In addition, in this manner, it is possible to reduce the burden on the operator for stably performing the sewing.

In addition, by providing the feed guide 22 in the presser foot 20, it is easy to allow the feed guide 22 to retreat together with the presser foot 20, and it is possible to easily perform handling of the cloth C on the throat plate 13.

In addition, the abutting portion 221 of the feed guide 22 is provided to be oscillatable in the upward-and-downward direction with respect to the presser foot 20 by the support portion 222 in a state of being pressed downward by the elastic body, and thus, regardless of the thickness of the cloth C, it is possible to allow the feed guide 22 to protrude downward from the side surface portion of the presser foot 20, thereby always guiding the cloth C.

In addition, it is not necessary to adjust the height of the support portion 222, and it is possible to reduce the work burden on the operator.

In addition, in the sewing machine 10, since the presser foot 20 is attachable to and detachable from the presser bar 23 which supports the presser foot 20, and the presser foot 20 provided with the feed guide 22 and the presser foot which is not provided with the feed guide are switchable, it is possible to perform not only the sewing along the side edge portion of the cloth C, but also other types of sewing, such as sewing of skewing by combining the feeding in the forward direction and the feeding in the lateral direction, or sewing for forming an arbitrary pattern by combining the forward-and-rearward sewing and the leftward-and-rightward sewing. Therefore, the sewing machine 10 can realize various types of sewing.

In addition, when changing the point of view, by adding the presser foot 20 provided with the feed guide 22 to the existing sewing machine which forms the arbitrary pattern by combining the forward-and-rearward sewing and the leftward-and-rightward sewing, it is possible to easily add a function of performing the sewing while maintaining a certain distance from the side edge portion with respect to the cloth C.

Others

In addition, in the above-described embodiment, a configuration in which, in a case where the presser foot 20 provided with the feed guide 22 is mounted on the presser bar 23, by inputting the information from the operation panel 41, the control device 90 controls the feed mechanism 30 to feed the workpiece by adding the moving component to the side of the abutting surface of the feed guide by the lateral feed mechanism 34, is described as an example, but the invention is not limited thereto.

For example, a configuration in which, on the side of the presser bar 23, in a case where the presser foot 20 provided with the feed guide 22 is mounted, detection means that can distinguish and recognize the general presser foot from the presser foot 20 is provided, and when the mounting of the presser foot 20 is detected, the control device 90 controls the feed mechanism 30 to feed the workpiece by recognizing the mounting and automatically adding the moving component to the side of the abutting surface of the feed guide by the lateral feed mechanism 34, may be employed.

In addition, as the detection means which can distinguish and recognize the presser foot 20 and the general presser foot, for example, detection means of which the external appearance is different in between the presser foot 20 and the general presser foot is employed, such as a microswitch which is turned ON only when the presser foot 20 is mounted, or a light-receiving element in which detected light is received or the detected light is blocked only when the presser foot 20 is mounted.

In addition, a case where the feed guide 22 is provided in the presser foot 20 is described as an example, but the feed guide may not be provided in the presser foot 20 as long as a structure in which the side edge portion of the workpiece is in an abutting state is achieved. For example, a wall surface-like feed guide which allows the side edge portion of the workpiece to abut against the upper surface of the throat plate 13 or the upper surface of the bed portion 81, may be provided.

The invention claimed is:

1. A sewing machine comprising:

a feed mechanism which feeds a workpiece by a feed dog partially protruding out upward from an upper surface of a throat plate and moving along a predetermined feeding direction;

a first presser foot which presses the workpiece on the upper surface of the throat plate from above, the first presser foot including a feed guide which has an abutting surface along the predetermined feeding direction and guides feeding of the workpiece;

a second presser foot which does not include a feed guide;

a presser bar which interchangeably supports the first presser foot or the second pressure foot; and a control device, wherein the feed mechanism includes a lateral feed mechanism which is capable of adding a moving component in a direction along the upper surface of the throat plate and orthogonal to the predetermined feeding direction, to the feed dog, wherein the lateral feed mechanism includes:

a leftward feed mechanism which is capable of adding a moving component in a leftward direction orthogonal to the predetermined feeding direction, to the feed dog, a neutral mechanism which does not add a moving component in a direction orthogonal to the predetermined feeding direction, to the feed dog, and a rightward feed mechanism which is capable of adding a moving component in a rightward direction orthogonal to the predetermined feeding direction, to the feed dog, wherein the control device controls the feed mechanism to feed the workpiece by adding a moving component of the workpiece toward a side of the abutting surface of the feed guide by the lateral feed mechanism, in addition to the feeding along the predetermined feeding direction, when the presser bar supports the first presser foot, and wherein the control device controls the feed mechanism to feed the workpiece without adding a moving component of the workpiece by the lateral feed mechanism, in addition to the feeding along the predetermined feeding direction, when the presser bar supports the second presser foot.

2. The sewing machine according to claim 1, wherein the feed guide is provided to be oscillatable in an upward-and-downward direction with respect to the first presser foot in a state of being pressed downward by an elastic body.

* * * * *